United States Patent [19]

Shaffer

[11] 3,994,633

[45] Nov. 30, 1976

[54] SCROLL APPARATUS WITH PRESSURIZABLE FLUID CHAMBER FOR AXIAL SCROLL BIAS

[75] Inventor: Robert W. Shaffer, Arlington, Mass.

[73] Assignee: Arthur D. Little, Inc., Cambridge, Mass.

[22] Filed: Mar. 24, 1975

[21] Appl. No.: 561,478

[52] U.S. Cl. ..... 418/5; 418/55; 418/57; 418/83; 418/99

[51] Int. Cl.² ..... F01C 1/02; F01C 11/00; F04C 17/02; F01C 19/00

[58] Field of Search ..... 418/5, 55, 83, 97, 99, 418/131, 133, 57

[56] References Cited

UNITED STATES PATENTS

| | | | |
|---|---|---|---|
| 1,475,683 | 11/1923 | Carrey | 418/131 |
| 1,766,005 | 6/1930 | Sullivan | 418/83 |
| 1,895,816 | 1/1933 | Pfeiffer | 418/83 |
| 2,098,652 | 11/1937 | Buckbee | 418/133 |
| 2,841,089 | 7/1958 | Jones | 418/55 |
| 3,600,114 | 8/1971 | Dvorak et al. | 418/55 |
| 3,817,664 | 6/1974 | Bennett et al. | 418/55 |
| 3,874,827 | 4/1975 | Young | 418/55 |
| 3,924,977 | 12/1975 | McCullough | 418/55 |

*Primary Examiner*—John J. Vrablik
*Attorney, Agent, or Firm*—Bessie A. Lepper

[57] ABSTRACT

A positive fluid displacement apparatus employing scroll members having interfitting spiroidal wraps angularly and radially offset such that as one of the scroll members is orbited, moving fluid pockets of variable volume and different fluid pressures are formed. Axial load carrying of the scroll members is achieved pneumatically through the introduction of a fluid into a pressurizable fluid chamber within the housing and in axial force applying relationship with the orbiting scroll member. The pressurizable fluid chamber may constitute essentially all or only a part of the internal volume of the housing and it is isolated from the fluid pockets. This type of axial load carrying materially reduces the loads which must be carried through the crankshaft and decreases the size and complexity of the bearings. The apparatus is particularly well suited to compressors operating at high exhaust pressures.

24 Claims, 15 Drawing Figures

SCROLL APPARATUS WITH PRESSURIZABLE FLUID CHAMBER FOR AXIAL SCROLL BIAS

The invention herein described was made in the course of or under a contract or subcontract thereunder, with the Department of the United States Navy.

This invention relates to fluid displacement apparatus and more particularly to apparatus for handling fluids to compress, expand or pump them.

The need for gas compressors and expanders and for fluid pumps is well known and there are many different types of such apparatus. In these apparatus a working fluid is drawn into an inlet port and discharged through an outlet port at a higher pressure; and when the fluid is a gas its volume may be reduced before delivery through the outlet port, in which case the apparatus serves as a compressor. If the working fluid is a pressurized gas when it is introduced and its volume is increased, then the apparatus is an expansion engine capable of delivering mechanical energy and also, if desired, of developing refrigeration. Finally, a fluid may be introduced and withdrawn at different pressures but without any appreciable change in volume, in which case the apparatus serves as a fluid pump.

In the following description of the fluid displacement apparatus of this invention it will be convenient to refer to it, and to the prior art, as a compressor. However, it is to be understood that the apparatus of this invention may also be used as an expansion engine and as a pump and its use as such will be apparent.

It is not necessary to discuss the prior art in detail as it pertains to such dynamic apparatus as centrifugal compressors and pumps, or as it pertains to the more commonly used positive-displacement devices of the vane, gear or other rotary types. However, it is of interest to note some of the features which characterize these general types of prior art apparatus as a basis for comparison with the fluid displacement apparatus of this invention.

Those pumps, compressors and blowers which may be termed "dynamic" apparatus must operate at high speeds to achieve large pressure ratios and they typically have efficiencies of less than 90% in terms of mechanical energy converted to flow and compressional energy. Apparatus of the dynamic type find their widest application in large sizes in such applications as gas turbine compressors, stationary power plant steam expanders, and the like.

The positive displacement pumps or compressors of the vane type have rubbing speeds proportional to the radius of the vanes and the input shaft speed. Furthermore, the vanes operate at varying angles of contact within a housing of fixed axial length so that any wear upon their flat surface ends will always act to increase the clearance, and hence, the blow-by or leakage of the apparatus. The positive-displacement pumps and compressors of the rotary type are typically constructed to have the rotating components movable between end plates, an arrangement which demands close tolerances to reduce blow-by while permitting free rotation. Wear between the rotating components and end plates increases blow-by, a fact which requires the adjustment of the spacings of the end plate through the use of screws and very precisely constructed gaskets in the form of shims. The gaskets may not, however, be able to withstand corrosive fluids or fluids at extreme temperatures, e.g., cryogenic liquids or hot gases. Furthermore, these gaskets require precisely located edges to prevent injury by the moving vanes, a fact which adds to the delicacy of assembling the apparatus.

In most industrial applications, particularly those of large scale, the fluid pumps and compressors now being used are adequate for the uses for which they are employed. However, there remains a need for a simple, highly efficient apparatus, essentially unaffected by wear which can handle a wide range of fluids and operate over a wide range of conditions to serve as a pump, compressor or expansion engine. The apparatus of this invention which meets these requirements is based on the use of scroll members having wraps which make moving contacts to define moving isolated volumes, called "pockets", which carry the fluid to be handled. The contacts which define these pockets formed between scroll members are of two types: line contacts between spiral cylindrical wrap surfaces, and area contacts betweeen plane surfaces. The volume of a sealed pocket changes as it moves. At any one instant of time, there will be at least one sealed pocket.

There is known in the art a class of devices generally referred to as "scroll" pumps, compressors and engines wherein two interfitting spiroidal or involute spiral elements of like pitch are mounted on separate end plates. These spirals are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls. In certain special cases the pocket or fluid volume will not extend the full 360° but because of special porting arrangements will subtend a smaller angle about the central region of the scrolls. The pockets define fluid volumes, the angular position of which varies with relative orbiting of the spiral centers; and all pockets maintain the same relative angular position. As the contact lines shift along the scroll surfaces, the pockets thus formed experience a change in volume. The resulting zones of lowest and highest pressures are connected to fluid ports.

An early patent to Creux (U.S. Pat. No. 801,182) describes this general type of device. Among subsequent patents which have disclosed scroll compressors, and pumps are U.S. Pat. Nos. 1,376,291, 2,475,247, 2,494,100, 2,809,779, 2,841,089, 3,560,119, 3,600,114, 3,802,809 and 3,817,664 and British Patent 486,192.

Although the concept of a scroll-type apparatus has been known for some time and has been recognized as having some distinct advantages, the scroll-type apparatus of the prior art has not been commercially successful, primarily because of sealing, wearing and, to some extent, porting problems which in turn have placed severe limitations on the efficiencies, operating life, and pressure ratios attainable. In particular, extensive experimentations with scroll machinery, along with detailed mathematical analyses of the sealing problems associated with scroll machinery, indicate that the attainment of good radial sealing is one of the principal factors in achieving acceptable operating efficiencies. This is particularly true in the case of compressors having high exhaust pressures (e.g., the second stage of a two-stage compressor) or of large-scale apparatus having a relative large total area of contact between the scroll wrap ends and the end plates with which they form moving seals.

One approach to the attainment of acceptable radial sealing in prior art apparatus has been to machine the components (wraps and end plates) to accurate shapes for fitting with very small tolerances to maintain radial sealing gaps sufficiently low to achieve useful pressure ratios. This is difficult to do and resembles the problem of constructing apparatus with a reciprocating piston without the use of sealing rings. In other prior art devices, radial sealing has been achieved through the use of one or more mechanical axial constraints, e.g., bolts to force the surfaces into contact (U.S. Pat. No. 3,011,694) requiring precise adjustment to attain efficient radial sealing without undue wearing. If during extended operation of such devices this adjustment is disarranged by one component experiencing more wear, or by any other mechanism, the problem of wear of other components may grow progressively worse until satisfactory radial sealing is no longer obtained. Another prior art approach to radial sealing has been the use of a combination of fluid and spring forces acting upon the orbiting scroll member, the fluid being derived from the moving fluid pockets defined within the apparatus (U.S. Pat. Nos. 3,600,114 and 3,817,664 and application Ser. No. 368,907 filed June 11, 1973, now U.S. Pat. No. 3,884,599. Further techniques for radial sealing also includes use of an axially compliant fixed scroll member with mechanical and/or pneumatic means to force the ends of the scroll wraps in sealing contact with the end plates of the opposite scroll members (see application Ser. No. 408,287 filed Oct. 23, 1973, in the name of Niels O. Young, now U.S. Pat. No. 3,874,827).

The use of surfaces machined to close tolerances or the use of mechanical constraints such as bolts to force axial contacts are not suitable technique for achieving radial sealing in commercially produced scroll apparatus. The use of a pressurized fluid drawn from or in communication with the fluid pockets defined between the scroll involutes (with or without springs to provide an augmenting axial force) is a satisfactory technique for achieving radial sealing for scroll machinery designed for a number of uses. Likewise the use of a fixed scroll member which is capable of undergoing very small excursions in the axial direction and which has some fluid and/or mechanical spring force applying means associated with it has advantages for certain applications.

There are, however, a number of applications for compressors, expanders and pumps where high pressures are handled and/or large horsepower sizes are required that can carry large drive loads with good wear life, operate over extended periods of time and be easily started up and shut down. In such scroll apparatus, it is highly desirable to eliminate the need for carrying the axial loads required for axial sealing through the crankshaft, for to do so would require excessively large and expensive bearings as well as large structural supports built into the apparatus housing. There is also a need for scroll machinery of this same general type which is capable of running without lubrication of the scroll members and free from the introduction of contaminants into the fluid passing through the apparatus. Exemplary of such equipment are helium compressors and expanders in cryogenic apparatus.

The scroll apparatus of this invention, in which the axial forces necessary to achieve axial load support are provided by pressurizing at least a portion of the internal volume of the scroll housing, minimizes the carrying of axial loads through the crankshaft and provides in some embodiments a purging system for apparatus running without lubricating the contacting surfaces of the scroll members.

It is therefore a primary object of this invention to provide scroll-type apparatus wherein efficient axial load carrying is attained through the pressurization of at least a portion of the internal volume of the scroll housing. It is another object of this invention to provide scroll apparatus of the character described which minimizes the axial loads carried through the crankshaft and thus minimizes the size of the bearings used and the size and weight of the housing. Another object of this invention is to provide relatively large-sized scroll apparatus which are simple to construct and assemble, and which provide uniform axial load carrying throughout start-up and shut-down as well as during operation. Yet another object is to provide scroll apparatus of the type described which is capable of efficiently handling high exhaust pressures.

Another primary object of this invention is to provide scroll type apparatus which achieves efficient axial load carrying through the use of a pressurizing fluid which is isolated from the fluid within the moving pockets defined by the scroll members. It is a further object to provide scroll apparatus which may run dry, i.e., free of lubrication of the scroll members and which may, if desired, provide continuous purging for the dry apparatus to prevent any contamination of the fluid flowing therethrough.

Other objects of the invention will in part be obvious and will in part be apparent hereinafter.

In the scroll apparatus of this invention, all of the forces required to achieve efficient axial load carrying are pneumatic forces provided by pressurizing all or a selected portion of the apparatus housing. Thus the housing defines with a surface of the orbiting scroll members a pressurizable chamber whereby the fluid pressure within that chamber forces the orbiting scroll into continued axial contact relationship with the fixed scroll member. This pressurizable chamber, which is isolated from the fluid pockets defined within the scroll members, may comprise essentially all of the internal volume of the housing or it may constitute less than the entire housing volume. In the latter case, the pressurizing chamber may also serve as a source of purging gas to continually remove any contaminants if the apparatus is to run dry. Mechanical axial compliance/sealing means may be used in conjunction with the pneumatic axial load carrying means of this apparatus.

The invention accordingly comprises the features of construction, combinations of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings in which FIG. 1 is a longitudinal cross section of a scroll-type compressor incorporating one embodiment of the axial load carrying means of this invention;

Figure 1:
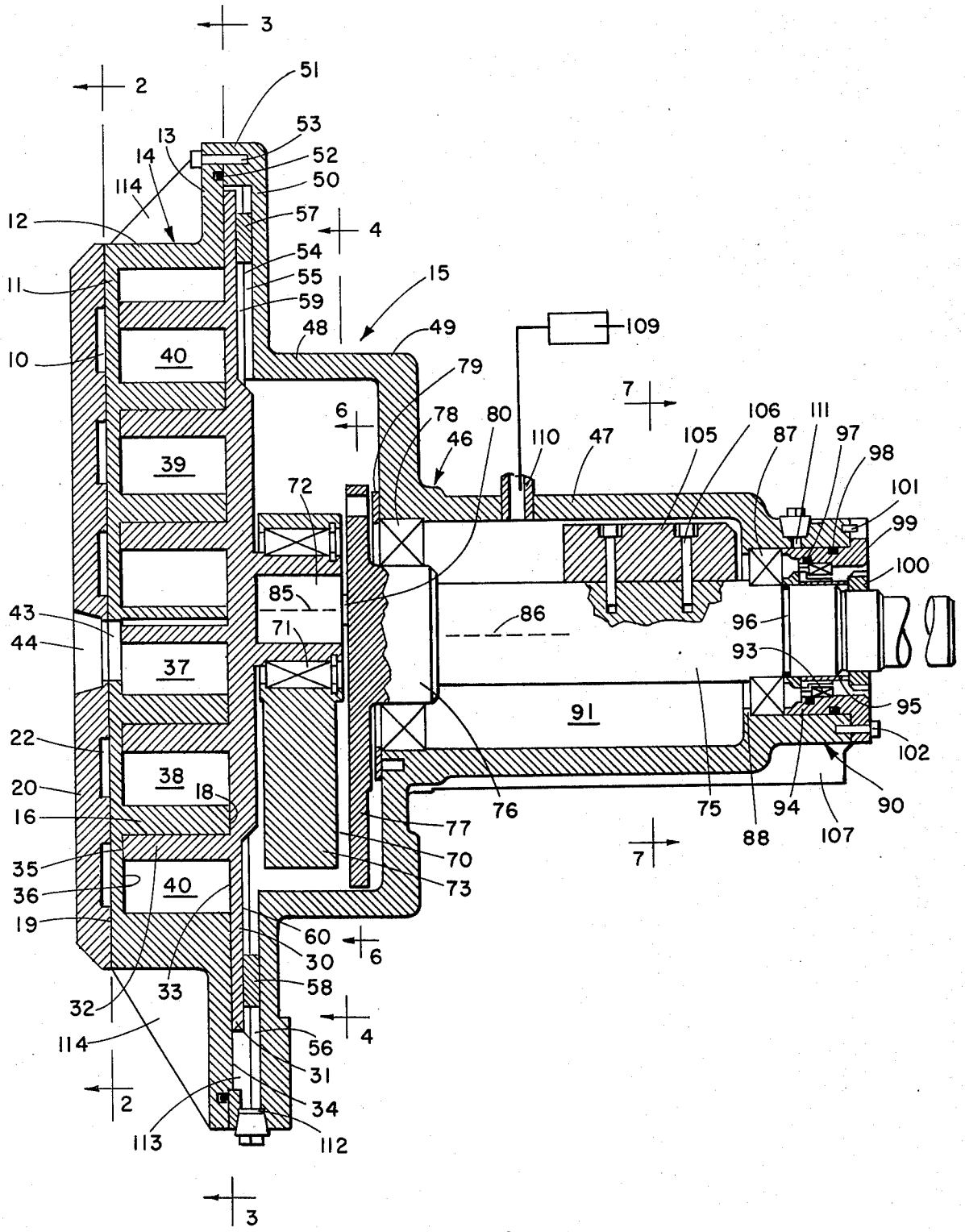

In the design and construction of scroll-type apparatus the problem of tangential sealing can be as important as that of radial sealing. Since radial and tangential sealing are usually, but not always, attained through separate mechanisms, the improved axial load carrying means of this invention may be employed in scroll-type apparatus using different tangential sealing techniques. However, since the unique tangential sealing means described in the above-identified copending applications Ser. Nos. 368,907 and 408,912 are believed to represent an important advance in scroll-type apparatus, the radial sealing means of this invention will be described in embodiments which include the tangential sealing means disclosed in Ser. No. 368,907 and more particularly in Ser. No. 408,912 now U.S. Pat. No. 3,924,977.

In copending application Ser. No. 368,907 there is disclosed a novel scroll apparatus in which tangential sealing is accomplished with minimum wear by using a driving mechanism which provides a centripetal radial force adapted to oppose a fraction of the centrifugal force acting on the orbiting scroll member. This driving mechanism incorporates a flexible linking of the orbiting scroll with its driving or orbiting means while the fixed scroll remains rigidly fixed with respect to the housing as well as to the orbiting scroll. In copending application Ser. No. 408,912 there is disclosed scroll apparatus which provides means to control the radial contacting forces such that tangential sealing is continuously and effectively attained even with wear or when noncompressibles are temporarily present. This means to control radial contacting comprises means to counterbalance at least a fraction of the centrifugal force acting upon the orbiting scroll member and radially compliant mechanical linking means between the orbiting scroll and its drive means. In one embodiment, the radially compliant mechanical linking means is capable of providing a centripetal force to counterbalance a fraction of the centrifugal force thereby having a portion of the centrifugal force available for achieving controlled tangential sealing. In this embodiment the compliant mechanical linking means incorporates mechanical springs to counteract a portion of the centrifugal force. In another embodiment of the drive mechanism of the apparatus described in Ser. No. 408,912, means separate from the radially compliant mechanical linking means, e.g., counterweights, are provided to counterbalance all or nearly all of the centrifugal forces acting upon the orbiting scroll member and the radially compliant linking means, i.e., mechanical springs, are incorporated to provide the desired tangential sealing forces. The scroll members are angularly positioned by a coupling of the sliding friction type or rolling element type; the radially compliant linking means may be a slide link or swing link; either one or both of the scroll members may be cooled and the contacting surfaces may be lubricated if desired. This latter type of radial compliance embodying a swing link will be used as illustrative of tangential sealing means in the apparatus described herein.

The principles of the operation of scroll apparatus have been presented in previously issued patents as well as in copending application Ser. No. 368,907, now U.S. Pat. No. 3,884,599. It is therefore unnecessary to repeat a detailed description of the operation of such apparatus. It is only necessary to point out that a scroll-type apparatus operates by moving a sealed pocket of fluid taken from one region into another region which may be at a different pressure. If the fluid is compressed while being moved from a lower to higher pressure region, the apparatus serves as a compressor; if the fluid is expanded while being moved from a higher to lower pressure region it serves as an expander; and if the fluid volume remains essentially constant independent of pressure then the apparatus serves as a pump.

The sealed pocket of fluid is bounded by two parallel planes defined by end plates, and by two cylindrical surfaces defined by the involute of a circle or other suitably curved configuration. The scroll members have parallel axes since in only this way can the continuous sealing contact between the plane surface of the scroll members be maintained. A sealed pocket moves between these parallel planes as the two lines of contact between the cylindrical surfaces move. The lines of contact move because one cylindrical element, e.g., a scroll member, moves over the other. This is accomplished, for example, by maintaining one scroll fixed and orbiting the other scroll. The load carrying means of this invention will, for the sake of convenience, be assumed to be used in a positive fluid displacement compressor in which one scroll member is fixed while the other scroll member orbits in a circular path. However, it will be obvious that the invention is equally applicable to expansion engines and pumps.

Throughout the following description the term "scroll member" will be used to designate the component which is comprised of both the end plate and the elements which define the contacting surfaces making movable line contacts. The term "wrap" will be used to designate the elements making movable line contacts. These wraps have a configuration, e.g., an involute of a circle (involute spiral), arc of a circle, etc., and they have both height and thickness. The thickness may vary over the arc length of the wrap.

Figure 2:
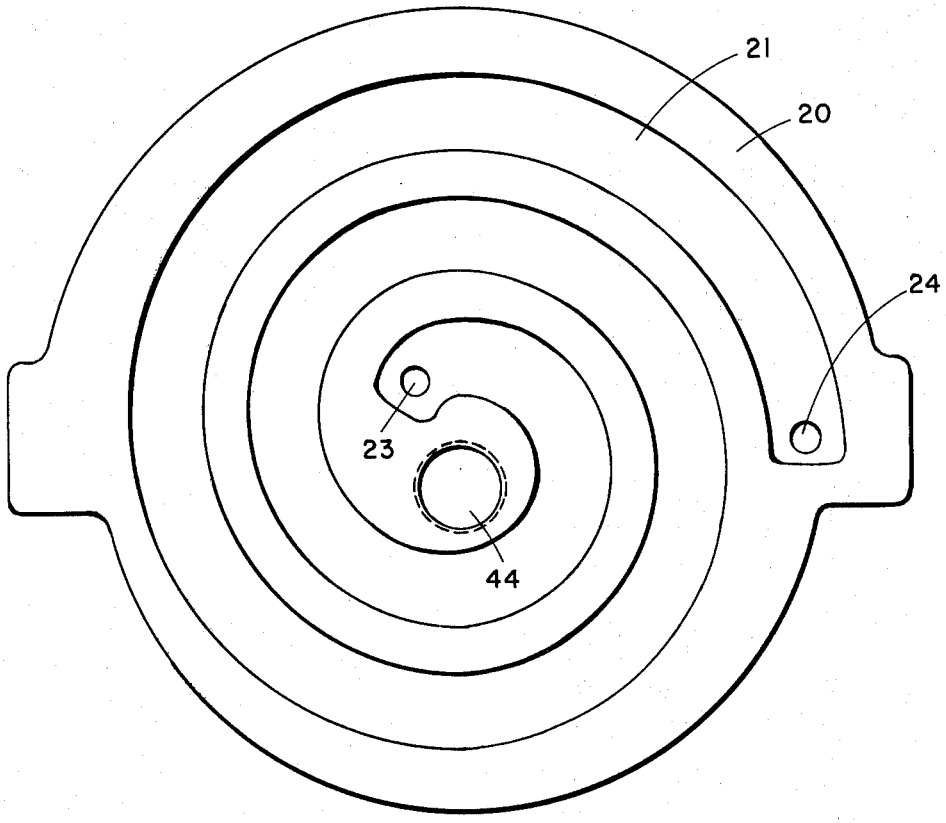
FIG. 2 is a cross section through plane 2—2 of FIG. 1 showing the liquid coolant channels associated with the fixed scroll member.
Figure 3:
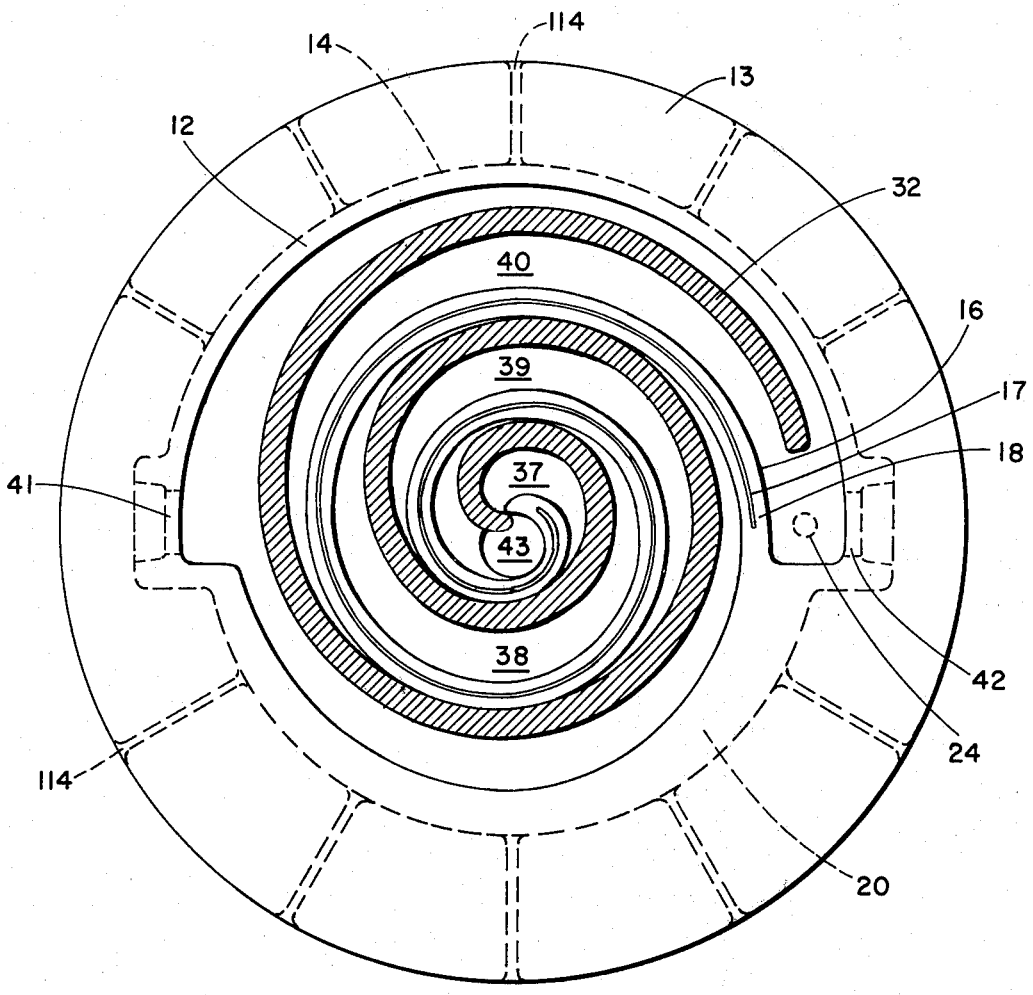
FIG. 3 is a cross section through plane 3—3 of FIG. 1 showing the wraps of the two scroll members and fluid ports.

FIG. 1 is a longitudinal cross section of a scroll compressor incorporating one embodiment of the axial load carrying means of this invention. The stationary scroll member 10 is formed of an end plate 11 which has a peripheral cylindrical wall 12 terminating in a flange 13, end plate 11, wall 12 and flange 13 forming one section 14 of housing 15. Stationary scroll member 10 has an involute wrap 16 which, as is shown in FIG. 3., has an oil groove 17 cut in its contacting surface 18. Affixed to the external surface 19 of end plate 11 is a housing plate member 20 which has a spirally shaped groove 21 cut into it. (See also FIG. 2) When assembled, groove 21 and external surface 19 of end plate 11 form a channel 22 through which a fluid coolant is circulated, the coolant being introduced through a central port 23 and withdrawn through a peripheral port 24. Channel 22 traces the involute spiral shape of the wrap of the stationary scroll member.

The orbiting scroll member 30 has an end plate 31 and an involute wrap 32 affixed thereto. The surface 33 of end plate 31 with which the wrap is integral, makes a sliding seal with surface 34 of flange 13. Likewise, this surface 33 forms a radial seal with surface 18 of the involute wrap 16 of the stationary scroll. In like manner, the surface 35 of involute wrap 32 forms a radial seal with surface 36 of the end plate 11 of the stationary scroll member 10. Thus there are defined one or more moving fluid pockets, e.g. 37, 38, 39 and 40 within the volume defined between end plates 11 and 31 as wraps 16 and 32 make sliding line contacts. It is therefore apparent that achieving radial contact between the wrap sides as they make this sliding contact when the orbiting scroll member is orbited seals against tangential leakage and hence attains tangential sealing. Likewise, the achieving of axial contact between the wrap ends and the end plate of the opposing scroll member seals against radial leakage and attains radial sealing.

In the compressor illustrated, the fluid to be compressed is introduced into the peripheral fluid pocket 40 through oppositely disposed inlet ports 41 and 42 (FIG. 3) and the compressed fluid is withdrawn from central fluid pocket 37 through discharge port 43 which is adapted to be connected with some compressed fluid utilization means, for example a reservoir (not shown) or other suitable mechanisms, e.g., an expansion engine, through port 44 in housing plate 20. This port 44 is adapted for engagement with a suitable fluid-carrying line (not shown).

The remaining or second section 46 of housing 15 comprises a drive shaft housing 47 and a swing link housing 48 connected through a shoulder 49. Swing link housing 48 terminates in a flange 50 having a peripheral ring 51 through which flange 13 of housing section 14 is joined and sealed through a sealing o-ring 52 by suitable means such as a plurality of bolts 53. The internal surface 54 of flange 50 has two oppositely disposed radial grooves 55 and 56 cut in it to serve as keyways for oppositely disposed keys 57 and 58 on one side of coupling ring 59 which is illustrated in a top plan view in FIG. 14. The outer surface 60 of the end plate 30 of the orbiting scroll has similar oppositively disposed radial grooves 61 and 62 (FIG. 14) which are spaced 90° from grooves 55 and 56 in the housing. These grooves 61 and 62 serve as keyways for oppositely disposed keys 63 and 64 on the other side of coupling ring 59. The purpose of this coupling ring is to maintian the stationary and orbiting scroll members in a predetermined fixed angular relationship.

As noted above, the driving mechanism for orbiting scroll member 30 which is used for illustrative purposes is one which incorporates means to overcome at least a fraction of the centrifugal force acting upon the stationary scroll member as the orbiting scroll member is driven. This counterbalancing means is illustrated in FIG. 1 as a swing link 70 attached through roller bearing 71 to a central shaft 72 which is affixed to or is an extension of end plate 31 of orbiting scroll member 30. A counterweight 73 of swing link 70 provides the means for overcoming a portion of the centrifugal force acting upon stationary scroll member 10 to lessen the wear on the contacting wrap surfaces while achieving efficient tangential sealing.

Figure 4:
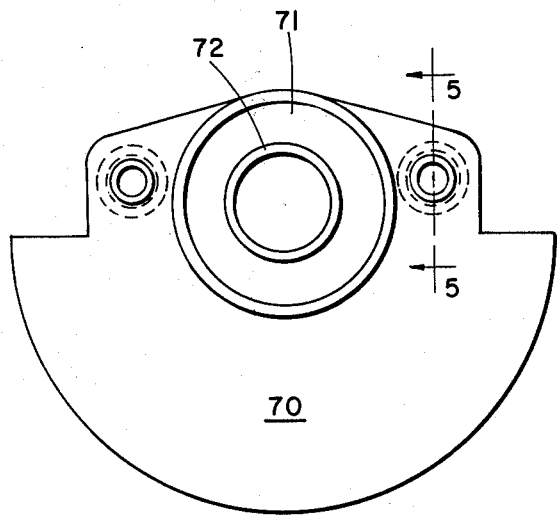
FIG. 4 is a cross section through plane 4—4 of FIG. 1 showing the swing link mechanism incorporated in the orbiting scroll drive means.
Figure 5:
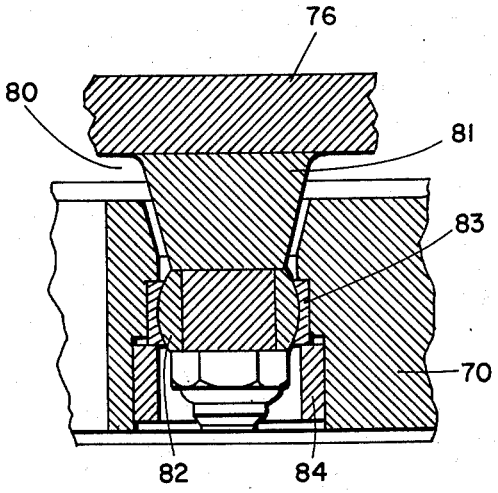
FIG. 5 is a cross section through plane 5—5 of FIG. 4 detailing the connection between the main drive shaft and the swing link mechanism.
Figure 6:
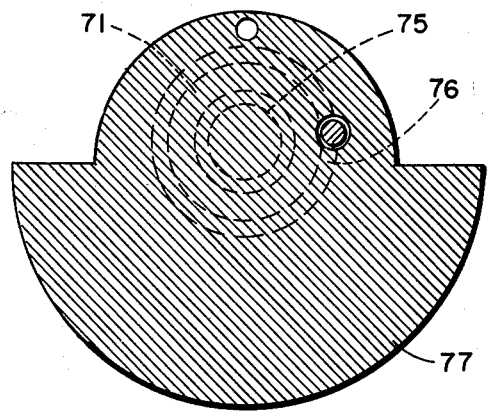
FIG. 6 is a cross section through plane 6—6 of FIG. 1 illustrating the counterweight means associated with the drive means.

The orbiting scroll member 30 is driven by a motor (not shown) through main drive shaft 75 and crankshaft 76, which are integral, to which a counterweight 77 is affixed. This counterweight provides both static and dynamic balancing of the inertial forces produced by the motion of the orbiting scroll and the swing link. Crankshaft 76 is supported in drive housing section 47 by ball bearings 78 and 87, bearing 78 being held in place by a suitably affixed bearing retainer ring 79 and bearing 87 by housing lip 88. The connection 80 of swing link 70 (and hence of orbiting scroll member 30) is made to drive shaft 75 through crankshaft 76 as illustrated in FIGS. 4, 5 and 6. This connection 80 comprises a tapered shaft 81 affixed to crankshaft 76 which extends into swing link 70 as shown in FIG. 5. Affixed to tapered shaft 81 is a ball joint 82 which is mounted in a bearing 83 held within the swing link 70 by a threaded retainer 84. Since axis 85 of the swing link is parallel to and spaced from axis 86 of main drive shaft 75 by a distance equal to the orbit radius of orbiting scroll member 30, rotation of drive shaft 75 effects the desired orbiting of scroll member 30.

A mechanical face seal, generally indicated by the reference numeral 90, seals off fluid volume 91 defined within housing section 46 from the atmosphere. In accordance with known practice, this mechanical face seal comprises element 93, mating rings 94 and 95, o-rings 96, 97 and 98, a seal adapter 99, a locknut 100, dowel pin 101 and a plurality of screws 102 to affix face seal 90 to drive shaft housing 47.

Figure 7:
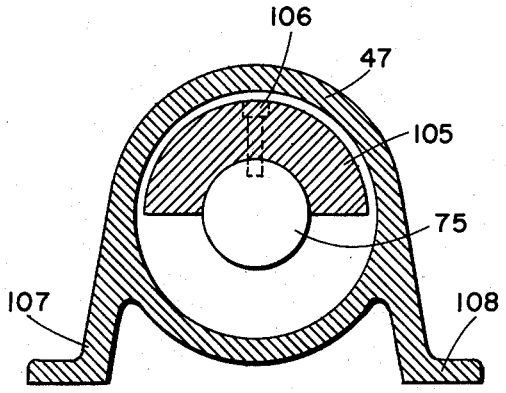
FIG. 7 is a cross section through plane 7—7 of FIG. 1 showing the housing and shaft counterweight.

A balancing counterweight 105 is affixed to main drive shaft 76, through screws 106, to minimize vibration in the apparatus. As will be seen in FIG. 7, the drive shaft housing 47 has supporting feet 107 and 108 for mounting the compressor on a support as will be described below in connection with the discussion of FIG. 15.

A fluid line 110 leads into volume 91 defined within the chamber housing. This line is adapted for connection to a source 109 of a suitable pressurizing fluid, e.g., air, nitrogen or the like. A closeable oil delivery port 111 and a closeable oil withdrawal port 112 are provided for introducing and discharging lubricating oil into the apparatus. The oil works its way across the contacting surfaces of the coupling means and into grooves 17 in the contacting surfaces of the wrap of the stationary scroll member, and it collects in the bottom of the housing volume 113 defined between the surfaces of the two flanges 13 and 50, which serves as an oil sump. Housing section 14 has a series of vanes 114 spaced around its outer surface to serve as heat transfer and structural surfaces.

In the operation of the compressor of FIG. 1, a fluid is used to pressurize volume 91 within the housing. Since the housing is generally not hermetically sealed it is usually necessary to maintain a connection between volume 91 and the source of pressurizing fluid, e.g., compressed air. Although the actual fluid pressure in housing volume 91 will be at least to some extent determined by such factors as compressor size, operating pressure range and efficiency of axial sealing required, it may be generally defined as being between the two pressure extremes within the apparatus, e.g., between inlet and discharge pressures for a compressor. The pneumatic forces acting upon the end plate 31 effect sealing between wrap surface 18 and end plate surface 33 and between wrap surface 35 and end plate surface 36 thus maintaining the pressure of the fluid in the different pockets at the desired different levels. Because volume 91 is isolated from the fluid pockets defined between end plates 11 and 31 of the scroll members, the axial load carrying means may be maintained at a desired level irrespective of the pressure events within the scroll pockets.

By providing these axially directed forces through pneumatic loading within the housing it is not necessary to carry such axial loads through the crankshaft or to use large, expensive bearings. This is particularly true where very high exhaust pressures are involved and/or large-sized apparatus is constructed. Moveover, it is not necessary to supply means, such as springs, to provide axial loading forces during start-up and shutdown as is the case where pressurizing fluid is withdrawn from the fluid pockets.

Figure 8:
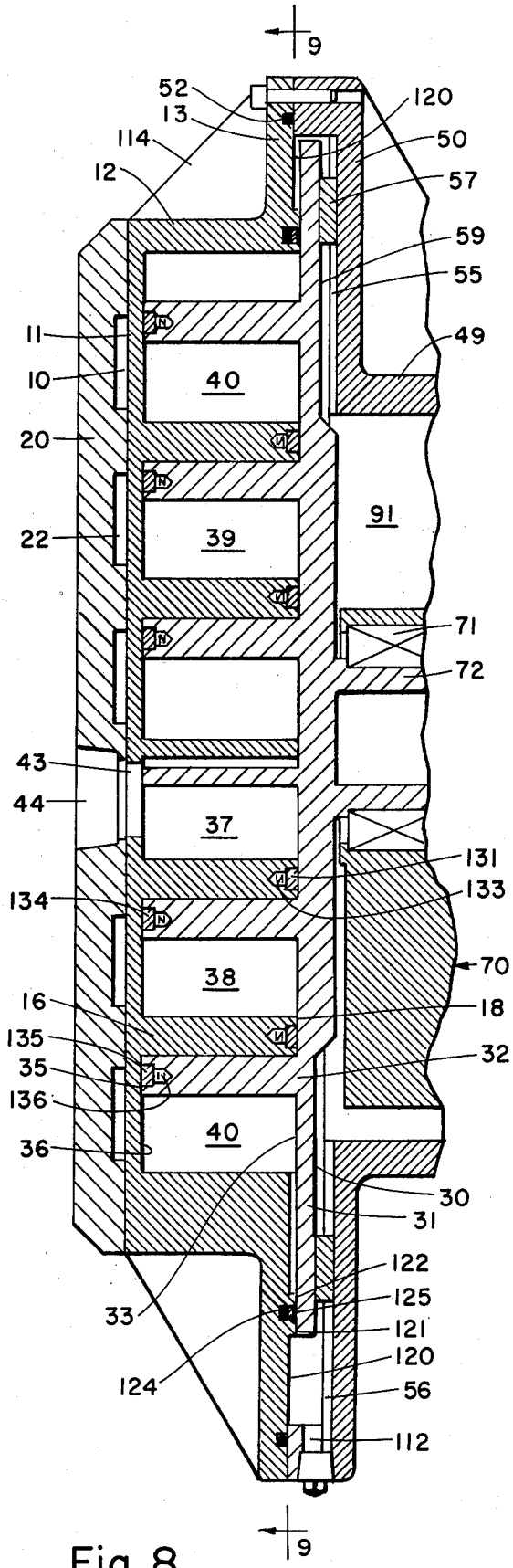
FIG. 8 is a fragmentary longitudinal cross section of the compressor of FIG. 1 showing the addition of mechanical axial compliance/sealing means comprising rings embedded in the scroll wrap surfaces and periodically spaced springs.

In FIG. 8, which is a fragmentary cross section of a compressor, there are illustrated a modification of the means for isolating housing volume 91 from the fluid pockets defined between the scroll members and mechanical axial compliance/ sealing means. It is to be understood that those apparatus components not shown in FIG. 8 are the same as illustrated in FIG. 1 and that the same reference numbers are used in both drawings to identify the same components.

Figure 10:
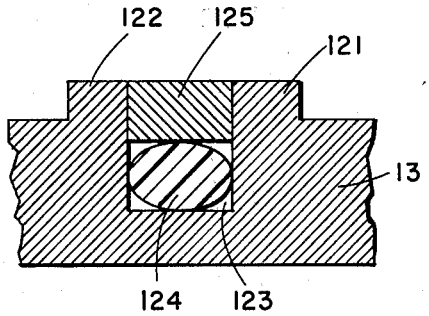
FIG. 10 is an enlarged detail of the seal of FIG. 8 used to isolate the internal pressurized housing from the fluid volumes defined within the scroll wraps.

In the modification of FIG. 8, the internal surface 120 of flange 13 is machined with a relief surface to leave only annular ring 121 to provide a sealing surface 122 with surface 33 of the end plate 31 of orbiting scroll member 30. As will be seen in the enlarged detail cross section of FIG. 10, an annular groove 123 is cut into ring 121 and end plate 13 to contain an elastomeric or metal sealing ring 124 and a contacting ring 125, which may be a metal or a nonmetal, which forms a sliding seal with surface 33. This seal isolates volume 91 from the fluid pockets within the scroll members.

Figure 9:
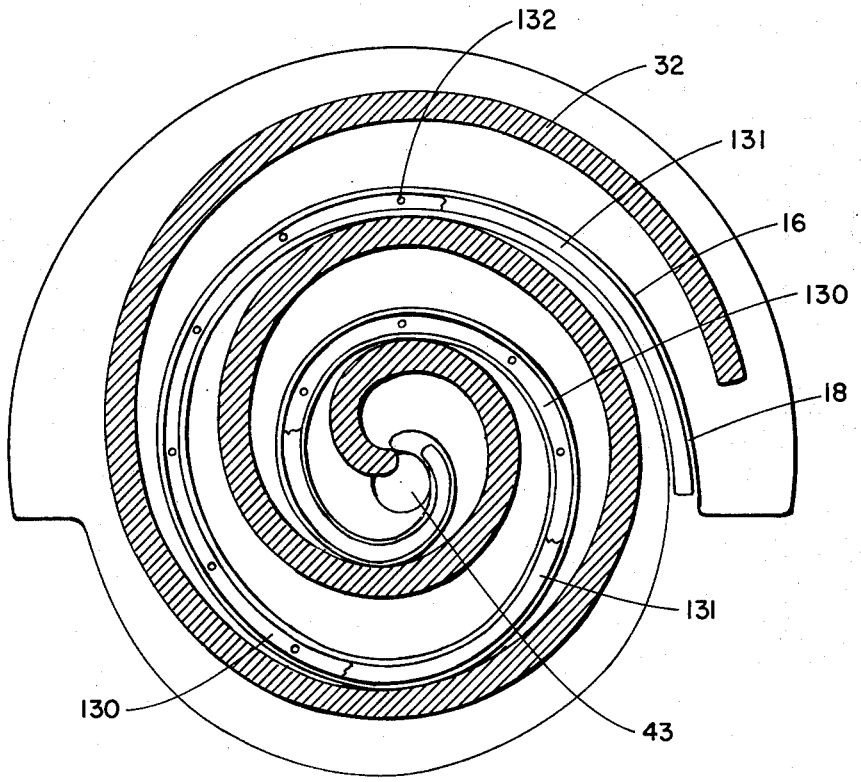
FIG. 9 is a cross section through plane 9—9 of FIG. 8 showing in top plane view the mechanical axial compliance/ sealing means of the stationary scroll member.
Figure 11:
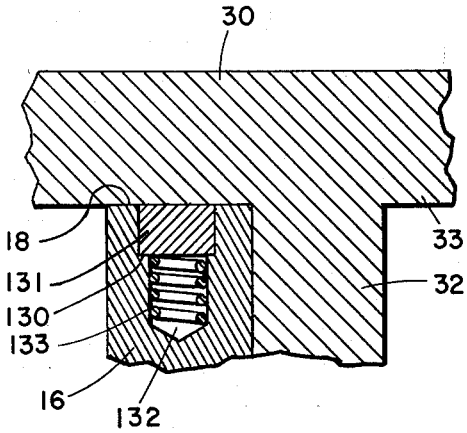
FIG. 11 is an enlarged detail of the mechanical axial compliance/sealing means of FIG. 8.

FIG. 8 also illustrates the incorporation of what is herein termed "mechanical axial compliance/sealing means" designed to ensure contact between the wrap ends and end plates of the two scroll members. These mechanical axial compliance/ sealing means are the subject of another application filed concurrently with this application in the names of John E. McCullough and Robert W. Shaffer. In the embodiment of these mechanical axial compliance/sealing means in FIG. 8 they take the form of spiral inserts on the two wrap surfaces forced by springs into sealing relation with the contacting end plate of the opposing scroll member. FIG. 11 shows a portion of this mechanical axial compliance/sealing means in enlarged detail. The surface 18 of wrap 16 of the stationary scroll member has machined in it a groove 130 in which is placed a sealing strip 131 configured as an involute spiral corresponding to the wrap spiral configuration as shown in FIG. 9. A plurality of spring wells 132, periodically spaced, are drilled in groove 130, each well being adapted to contain a spring 133 in compression in force-applying relationship with sealing strip 131 so that the sealing strip is urged into radial sealing contact with surface 33 of orbiting scroll 30. In this embodiment, specific oil grooves (such as groove 17 of FIG. 3) are eliminated since groove 130 can serve as a means for circulating oil and for making it available to the surfaces of the floating sealing strip 131.

In like manner, the surface 35 of wrap 32 of orbiting scroll member 30 has a groove 134 in it to hold a sealing strip 135 and a plurality of wells to contain springs 136. In this manner sealing strip 135 is urged in sealing contact with surface 36 of the end plate 11 of the stationary scroll. The use of the involute sealing rings and springs ensures continued radial sealing, achieved through the fluid pressure in volume 91, even if some wear is experienced by the contacting surfaces. Thus these mechanical axial compliance/sealing means enhance the efficiency of the pneumatic axial loading means of this invention, particularly over prolonged periods of operation, since they provide any necessary compliance for difference in wrap heights, wear, etc.

In apparatus which are to be oil lubricated, the sealing strips 131 and 135 may be formed of a hard wear resistance metal. If the apparatus is to run without lubrication, then these sealing strips may be formed of a self-lubricating material such as a filled, or surface-treated, polytetrafluoroethylene.

Figure 12:
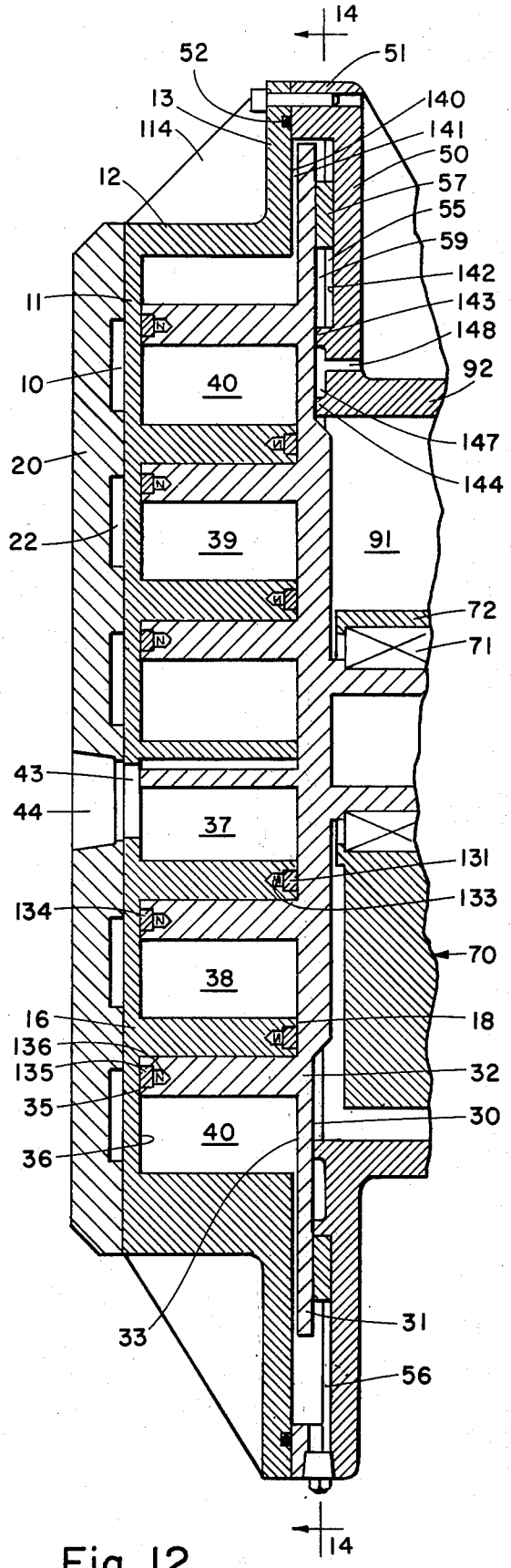
FIG. 12 is a fragmentary longitudinal cross section of a scroll-type compressor incorporating another embodiment of the axial load carrying means of this invention.
Figure 13:
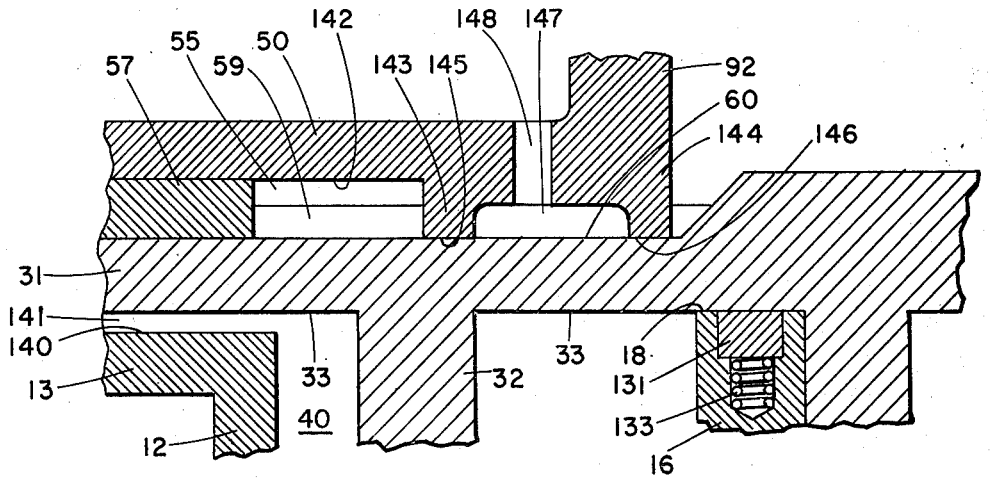
FIG. 13 is an enlarged detail cross section of the pressurized axial sealing chamber of FIG. 12.
Figure 14:
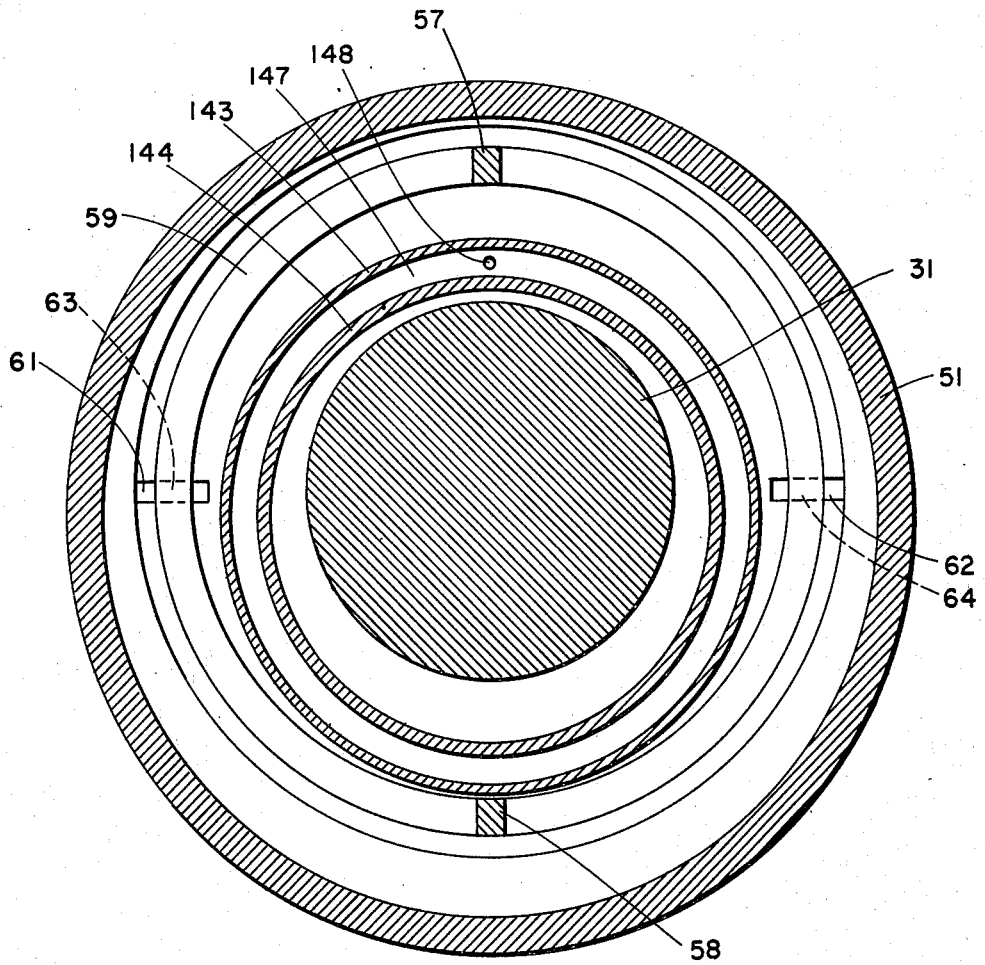
FIG. 14 is a cross section through plane 14—14 of FIG. 12 showing the pressurized axial sealing chamber and the coupling means.

In FIG. 12, which is a fragmentary cross section of a compressor, there is illustrated another embodiment of the axial load carrying means of this invention. It is to be understood that those apparatus components, with one exception noted below, which are not shown in FIG. 12 are the same as illustrated in FIG. 1 and that the same reference numbers are used in both drawings to identify the same components. Whereas the entire volume 91 within the housing serves as the fluidized pressure chamber in the embodiment of FIG. 1, the internal wall of the housing in FIG. 12 is modified to provide a pressurized chamber of limited volume. In the embodiment of FIGS. 12–14, flange 13 has an internal surface 140 defining a narrow spacing 141 with surface 33 of orbiting end plate 31 thus eliminating the seal at these surfaces. The internal wall 142 of flange 50 is configured to have concentric rings 143 and 144 having surfaces 145 and 146, respectively, which make sealing contact with outer surface 60 of end plate 31 to define a pressurizable chamber 147 into which a pressurizing gas is delivered from a suitable source (not shown) through a fluid inlet port 148 in flange 50. It will be seen from FIG. 12–14 that the internal housing is configured to provide the pressurizable chamber 147 inside coupling ring 59. It is also, of course, possible to reverse the positions of these components by forming the pressurizable chamber nearer to the periphery of flange 50 and placing the coupling ring inside of ring 144. Because the entire internal volume of the housing is not pressurized, mechanical face seal 90 (FIG. 1)

may be eliminated using only a suitable bearing, i.e., ball bearing 87.

The embodiment of FIGS. 12–14 is particularly suitable for a compressor or expander which must operate without a lubricant such as oil. Since the seals between surfaces 145 and 146 and surface 60 of end plate 31 will not be hermetic, a small amount of the pressurizing gas, which is supplied continuously to chamber 147 will leak out between surfaces 145 and 60 and pass by way of passage 140 into peripheral pocket 40 as well as between surfaces 146 and 60 to enter the main housing volume 91. Thus the pressurizing gas serves as a purging gas as well as providing the required contact between the wraps and end plates to achieve effective axial sealing.

It will be seen that the embodiment of FIGS. 12–14 incorporates the mechanical axial compliance/sealing means of FIGS. 8, 9 and 11. It is preferable, although not necessary, that these be included in the embodiment of FIGS. 12–14. The embodiment of FIGS. 12–14 of the axial load carrying means of this invention is perferred for compressors and expanders operating on fluids, such as helium, in which gaseous contaminants must be minimized or eliminated. This may be best achieved by using the same fluid in chamber 147 as is being compressed (or expanded) and by forming sealing rings 131 and 135 from a self-lubricating material.

Figure 15:
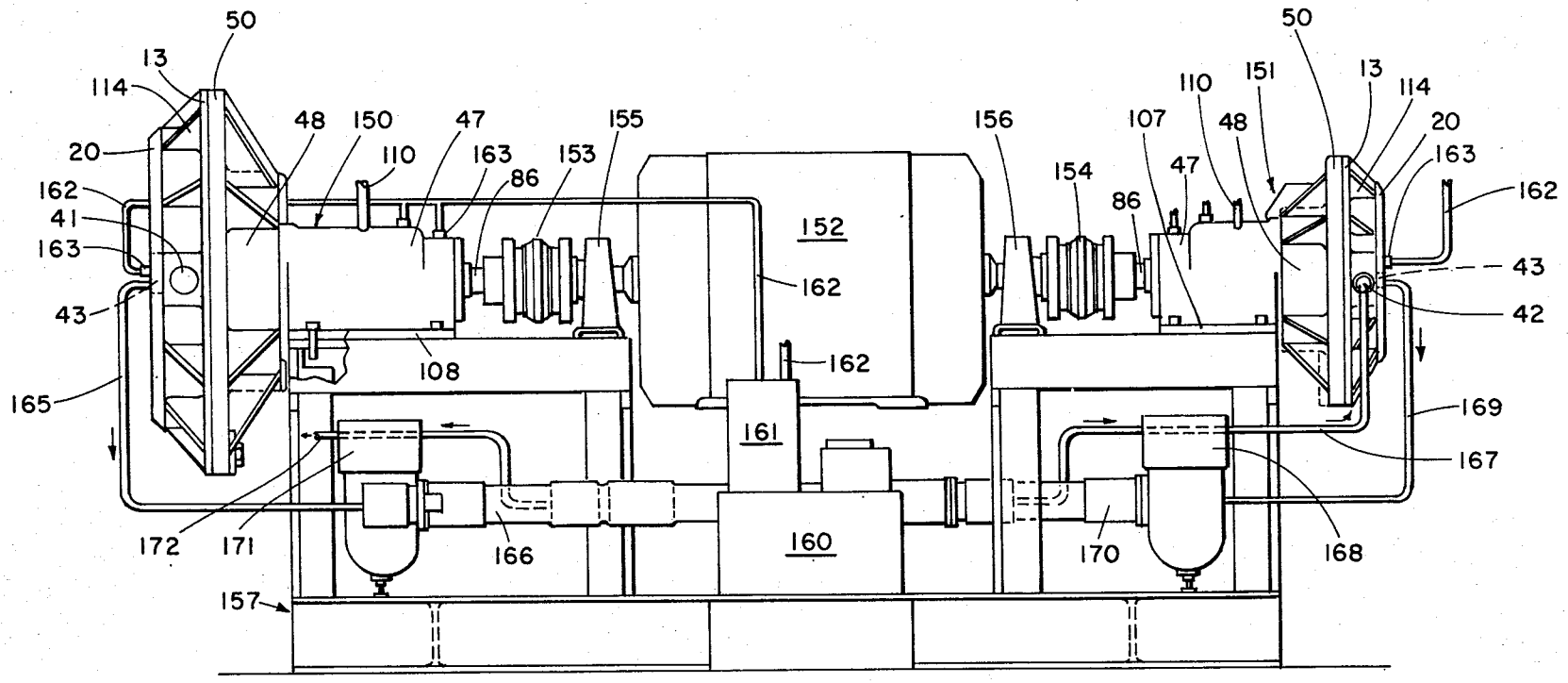
FIG. 15 is a side elevational view of a two-stage compressor constructed in accordance with this invention.

As previously pointed out, scroll apparatus constructed in accordance with this invention are particularly suited to compressors or expanders designed to handled relatively high pressures. A two-stage compressor having an overall pressure ratio of 16 to 1 may be taken is exemplary of such apparatus. Such a compressor constructed in accordance with this invention is illustrated in FIG. 15. In this compressor the first stage 150 and second stage 151 are constructed as illustrated in detail in FIGS. 1–14. Since the two stages 150 and 151 are essentially identical in basic construction except for size, the same reference numerals are used to identify comparable components in each stage. These reference numerals are, in turn, the same used and identified in the preceding drawings. The two stages are driven by a centrally-positioned motor 152. The first-stage drive shaft 86 is coupled through coupling 153 to one shaft of motor 152, and the second-stage drive shaft 86 is coupled through coupling 154 to the other shaft motor 152. The motor is supported in pillow blocks 155 and 156, and the two compressors are supported by legs 107 and 108 (see FIG. 7) on a frame generally indicated by the reference numeral 157.

Lubricating oil is provided from reservoir 160 and is delivered by pump 161 through line 162 and oil metering units 163 to the scroll driving mechanism and to the scroll members.

In operation, the gas to be compressed, e.g., ambient air or helium from a suitable source is taken into the first stage compressor 150 through peripheral ports 41 and 42 (only port 41 being shown) and subsequent to compression is discharged through central port 43 into compressed gas line 165 and then through an intercooler 166. The intercooler in constructed in accordance with any well-known design and cooled by water. From intercooler 166 the initially compressed gas is taken by conduit 167 through a filter 168 and then to the inlet ports 41 and 42 (41 not being shown) of the second stage compressor 151. The exhaust gas from stage 151 at maximum pressure is then taken by discharge conduit 169 to an aftercooler 170 which is shown to be in back of intercooler 166. The cooled, finally compressed gas is then passed through a filter 171 and then delivered through conduit 172 to any desired point.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

I claim:

1. In a positive fluid displacement apparatus into which a fluid is introduced through an inlet port for circulation therethrough and subsequently withdrawn through a discharge port, and in which two scroll members having end plates and wraps which make moving line contacts to seal off and define at least one moving pocket of variable volume and zones of different fluid pressure when one of said scroll members is driven to orbit said other scroll member while maintaining a fixed angular relationship therewith and driving means including crankshaft means for orbiting said one of said scroll members, the improvement comprising housing means enclosing said crankshaft means and defining with said one of said scroll members a pressurizable fluid chamber means whereby the fluid pressure within said chamber forces said one of said scroll members into axial contact relationship with said other of said scroll members to provide axially directed forces through fluid pressure loading within said housing, and means connecting said pressurizable fluid chamber with our external source of a pressurized fluid, said pressurizable fluid chamber being isolated from said moving pocket.

2. A positive fluid displacement apparatus in accordance with claim 1 wherein said pressurizable fluid chamber means comprises essentially the entire void volume of said housing means.

3. A positive fluid displacement apparatus in accordance with claim 1 wherein said pressurizable fluid chamber comprises an annular chamber defined by concentric annular rings being extensions of the internal wall of said housing and having surfaces making sealing contact with the end plate of said one of said scroll members.

4. A positive fluid displacement apparatus in accordance with claim 1 including oil grooves in the contacting surfaces of said wraps.

5. A positive fluid displacement apparatus in accordance with claim 1 including channel defining means associated with the end plate of said other of said scroll members to provide a fluid channel configured to trace the involute configuration of said wrap of said other of scroll members and means to circulate a fluid coolant through said channel.

6. A positive fluid displacement apparatus in accordance with claim 1 in which said other of said scroll members includes a peripheral scroll housing section integral with the end plate of said other of said scroll members, said end plate terminating in an outwardly extending flange having a surface sealably engaging a surface of the end plate of said one of said scroll members whereby the engagement of said surface of said flange and of said surface of said end plate of said one of said scroll members provides the required isolation of said pressurizable fluid chamber from said moving pocket.

7. A positive fluid displacement apparatus in accordance with claim 6 wherein said surface of said flange sealably engaging said surface of said end plate is in the form of an annular ring raised above said flange surface.

8. A positive fluid displacement apparatus in accordance with claim 7 wherein said annular ring is grooved and contains a contacting ring urged in sealing contact with said surface of said end plate of said one of said scroll members by an elastomeric or metal sealing ring in said groove.

9. A positive fluid displacement apparatus, comprising in combination a. a first stationary scroll member comprising first wrap means affixed to a first end plate having a peripheral cylindrical housing member terminating in an outwardly directed flange;

b. a second orbiting scroll member comprising second wrap means affixed to a second end plate terminating in a peripheral annular extension, said first and second wrap means making moving line contacts when said second scroll member is orbited to seal off and define at least one moving pocket of variable volume and zones of different fluid pressure;

c. scroll orbiting means including crankshaft means associated with said second scroll member, adapted to effect orbital motion of said second scroll member;

d. coupling means adapted to prevent relative angular motion of said first and second scroll members;

e. housing means enclosing said crankshaft means and being affixed through sealing means to said flange of said first scroll member thereby to define an internal housing volume; and f. axial load-carrying means comprising a pressurizable fluid chamber within said housing means whereby the fluid pressure within said chamber forces said second orbiting scroll member into axial contacting relationship with said first stationary scroll member to provide axially directed forces through fluid pressure loading within said housing, and means connecting said pressurizable fluid chamber with an external source of a pressurized fluid, said pressurizable fluid chamber being isolated from said moving pocket.

10. A positive fluid displacement apparatus in accordance with claim 9 wherein said pressurizable fluid chamber comprises essentially all of said internal housing volume.

11. A positive fluid displacement apparatus in accordance with claim 9 including channel defining means associated with said end plate of said first scroll member to provide a fluid channel configured to trace the involute configuration of said wrap of said first scroll member and means to circulate a fluid coolant through said channel.

12. A positive fluid displacement apparatus in accordance with claim 9 wherein said scroll orbiting means includes means to provide a centripetal radial force adapted to oppose at least a fraction of the centrifugal force acting upon said first scroll member is maintained at a level to minimize both wear and internal fluid leakage.

13. A positive fluid displacement apparatus in accordance with claim 9 wherein at least a portion of one surface of said flange of said first scroll member makes sealing contact with a surface of said peripheral annular extension of said second scroll member thereby isolating said pressurizable chamber from said fluid pocket.

14. A positive fluid displacement apparatus in accordance with claim 13 wherein said one surface of said flange is configured to have an annular ring to make said sealing contact, said annular ring being grooved to contain a contacting ring urged in sealing contact with said surface of said peripheral annular extension of said second scroll member by an elastomeric ring in said groove.

15. A positive fluid displacement apparatus in accordance with claim 9 wherein said housing means includes a housing flange defining a spacing with said flange of said first scroll member into which said peripheral annular extension of said second scroll member extends.

16. A positive fluid displacement apparatus in accordance with claim 15 wherein the internal surface of said housing flange has a first pair of oppositely disposed keyways, said end plate of said second scroll member has a second pair of oppositely disposed keyways located 90° from said first pair, and said coupling means comprises a ring having a first pair of keys on one side for slidably engaging said first pair of keyways and a second pair of keys on the other side for slidably engaging said second pair of keyways.

17. A positive fluid displacement apparatus in accordance with claim 15 wherein said pressurizable fluid chamber comprises an annular chamber defined by concentric annular rings being extensions of the internal wall of said housing flange and having surfaces making sealing contact with the surface of said end plate of said second scroll member.

18. A multistage compressor comprising, in combination a. a first-stage compressor;

b. a second-stage compressor;

c. first fluid conduit means, including intercooler means, connecting the exhaust port of said first-stage compressor with the inlet port of said second-stage compressor;

d. second fluid conduit means, including after-cooling means, connecting the exhaust port of said second-stage compressor with compressed-fluid utilization means; and e. motor means; each of said first-stage and second-stage compressors comprising, in combination 1. a first stationary scroll member comprising first wrap means affixed to a first end plate having a peripheral cylindrical housing member terminating in a flange;

2. a second orbiting scroll member comprising second wrap means affixed to a second end plate terminating in a peripheral annular extension, said first and second wrap means making moving line contacts when said second scroll member is orbited to seal off and define at least one moving pocket of variable volume and zones of different fluid pressure;

3. scroll orbiting means including crankshaft means coupled to said motor means for effecting orbital motion of said second scroll member;

4. coupling means adapted to prevent relative angular motion of said first and second scroll members;

5. housing means enclosing said crankshaft means and being affixed through sealing means to said flange of said first scroll member thereby to define an internal housing volume; and 6. axial load-carrying means comprising a pressurizable fluid chamber within said housing means whereby the fluid pressure within said chamber forces said second orbiting scroll member into axial contacting relationship with said first stationary scroll member to provide axially directed forces through fluid pressure loading within said housing, and means connecting said pressurizable fluid chamber with an external source of a pressurized fluid, said pressurizable fluid chamber being isolated from said moving pocket.

19. A multistage compressor in accordance with claim 18 wherein said pressurizable fluid chamber in each of said first and second compressors comprises essentially all of said internal housing volume.

20. A multistage compressor in accordance with claim 18 wherein said scroll orbiting means of each of said first and second compressors includes means to provide a centripetal radial force adapted to oppose at least a fraction of the centrifugal force acting upon said first scroll member, whereby the tangential sealing force between said scroll members is maintained at a level to minimize both wear and internal fluid leakage.

21. A multistage compressor in accordance with claim 18 wherein within each of said first and second compressors at least a portion of one surface of said flange of said first scroll member makes sealing contact with a surface of said peripheral annular extension of said second scroll member, thereby isolating said pressurizable chamber from said fluid pocket.

22. A multistage compressor in accordance with claim 21 wherein said one surface of said flange is configured to have an annular ring to make said sealing contact, said annular ring being grooved to contain a contacting ring urged in sealing contact with said surface of said perpheral annular extension of said second scroll member by an elastomeric ring in said groove.

23. A multistage compressor in accordance with claim 18 wherein said housing means of each of said first and second compressors includes a housing flange defining a spacing with said flange of said first scroll member into which said peripheral annular extension of said second scroll member extends.

24. A multistage compressor in accordance with claim 23 wherein said pressurizable fluid chamber comprises an annular chamber defined by concentric annular rings being extensions of the internal wall of said housing flange and having surfaces making sealing contact with the surface of said end plate of said second scroll member.

* * * * *